US006620026B1

(12) United States Patent
Guilani et al.

(10) Patent No.: US 6,620,026 B1
(45) Date of Patent: Sep. 16, 2003

(54) MATERNITY SUPPORT GARMENT

(76) Inventors: Ehsan Guilani, 324 N. Palm Dr., #303, Beverly Hills, CA (US) 90210; Ramin Guilani, 16425 Oldham St., Encino, CA (US) 91436; Rassam Guilani, 11740 Wilshire Blvd., #A402, Los Angeles, CA (US) 90025

( * ) Notice: Subject to any disclaimer, the term of this patent is extended or adjusted under 35 U.S.C. 154(b) by 0 days.

(21) Appl. No.: 10/126,631

(22) Filed: Apr. 18, 2002

(51) Int. Cl.[7] ..... A41D 13/06

(52) U.S. Cl. ..... 450/155; 128/96.1; 128/90.1; 450/96

(58) Field of Search ..... 450/155, 151, 450/94, 96–98, 100, 101, 115, 116, 122, 123, 125, 127, 128, 131, 132, 133; 128/90.1, 96.1, 99.1, 101.1, 100.1; 602/19; 2/44, 45, 310–312, 338, 237, 221, 76, 92, 400–408, 227, 228, 238

(56) References Cited

U.S. PATENT DOCUMENTS

| | | | | | |
|---|---|---|---|---|---|
| 1,185,672 | A | * | 6/1916 | Huettner | 450/155 |
| 1,572,826 | A | * | 2/1926 | Virgin | 450/155 |
| 1,604,076 | A | * | 10/1926 | Rissett | 450/155 |
| 1,633,610 | A | | 6/1927 | Schneider | |
| 1,923,112 | A | | 8/1933 | Nickerson | |
| 2,099,238 | A | | 11/1937 | Simpson | |
| 2,259,236 | A | | 10/1941 | Wellins et al. | |
| RE22,665 | E | | 8/1945 | Mahoney | |
| 2,462,195 | A | | 2/1949 | Jacobson | |
| 2,513,039 | A | | 6/1950 | Miller | |
| 2,646,572 | A | | 7/1953 | Eudy | |
| RE23,818 | E | | 4/1954 | Vraciu | |
| 3,142,300 | A | | 7/1964 | Erteszek | |
| 3,221,750 | A | | 12/1965 | Blair | |
| 3,245,410 | A | | 4/1966 | Martin | |
| 3,406,692 | A | | 10/1968 | Pernas | |
| 3,487,418 | A | | 12/1969 | Jacobs | |
| 3,524,449 | A | * | 8/1970 | Peters | 450/155 |
| D218,586 | S | | 9/1970 | Williams | |
| 3,621,849 | A | | 11/1971 | Williams | |
| 4,557,268 | A | * | 12/1985 | Maddux et al. | 450/155 |
| 4,697,592 | A | * | 10/1987 | Maddux et al. | 450/155 |
| 4,893,358 | A | | 1/1990 | Bice, Jr. | |
| 4,956,878 | A | | 9/1990 | Boynton | |
| 4,981,480 | A | | 1/1991 | Gaudet et al. | |
| 5,217,403 | A | | 6/1993 | Nobbs | |
| 5,613,893 | A | * | 3/1997 | Zagame | 450/155 |
| 6,338,666 | B1 | * | 1/2002 | Ishii | 450/96 |
| 6,454,628 | B1 | * | 9/2002 | Shunichirou | 450/155 |

FOREIGN PATENT DOCUMENTS

| | | |
|---|---|---|
| CA | 519576 | 12/1955 |
| FR | 2443811 | 11/1980 |

* cited by examiner

*Primary Examiner*—Gloria M. Hale
(74) *Attorney, Agent, or Firm*—William W. Haefliger

(57) ABSTRACT

A maternity support garment, comprising a carrier configured to extend around the wearer's body, above the level of the wearer's legs; two elongated support bands, one band having a rear portion with operative connection to the rear of the carrier; a right side portion to extend at the right side of the wearer's body; and a frontal portion to extend in supporting relation to the wearer's abdomen, and the other band having a rear portion with operative connection to the rear of the carrier, a left side portion to extend at the left side of the wearer's body, and a frontal portion to extend in supporting relation to the wearer's abdomen, at least one operative connection being adjustable to lengthen or shorten the associated bands, the band frontal portions being adjustably interconnected.

17 Claims, 4 Drawing Sheets

MATERNITY SUPPORT GARMENT

BACKGROUND OF THE INVENTION

This invention relates generally to maternity garments, and more particularly to garments to adjustably support the distended abdomen, during pregnancy.

There is recognized great need for satisfactory lower abdominal and lower back support, during pregnancy, particularly during later stages of pregnancy. No apparatus of which we are aware provides the many unusual and cooperating advantages in structure, function and improved results as are now provided by the present maternity garment invention, as will appear.

SUMMARY OF THE INVENTION

It is a major object of the invention to provide an improved maternity support garment, meeting the stated need. Basically, the garment of the invention comprises a) a carrier configured to extend around the wearer's body, above the level of the wearer's legs, b) two elongated support bands, one band having a rear portion with operative connection to the rear of the carrier; a right side portion to extend at the right side of the wearer's body; and a frontal portion to extend in supporting relation to the wearer's abdomen, and the other band having a rear portion with operative connection to the rear of the carrier, a left side portion to extend at the left side of the wearer's body, and a frontal portion to extend in supporting relation to the wearer's abdomen, c) at least one of the operative connections being adjustable to lengthen or shorten the associated bands, d) the band frontal portions being adjustably interconnected.

Additional objects include provision for use of rear portions of the bands to provide added back support if needed through band adjustment, for adjustability of both band operative connections at the rear of the carrier, as for lengthening or shortening; provision in one or both bands of-parallel elongated relatively narrow strips of flexible material which are spaced apart widthwise of the one band, and along the band length; and band frontal portions having adjustable (lengthwise and twisting) interconnection, as via hook and pile (VELCRO) material.

These and other objects and advantages of the invention, as well as the details of an illustrative embodiment, will be more fully understood from the following specification and drawings, in which:

DRAWING DESCRIPTION

DETAILED DESCRIPTION

Figure 1:
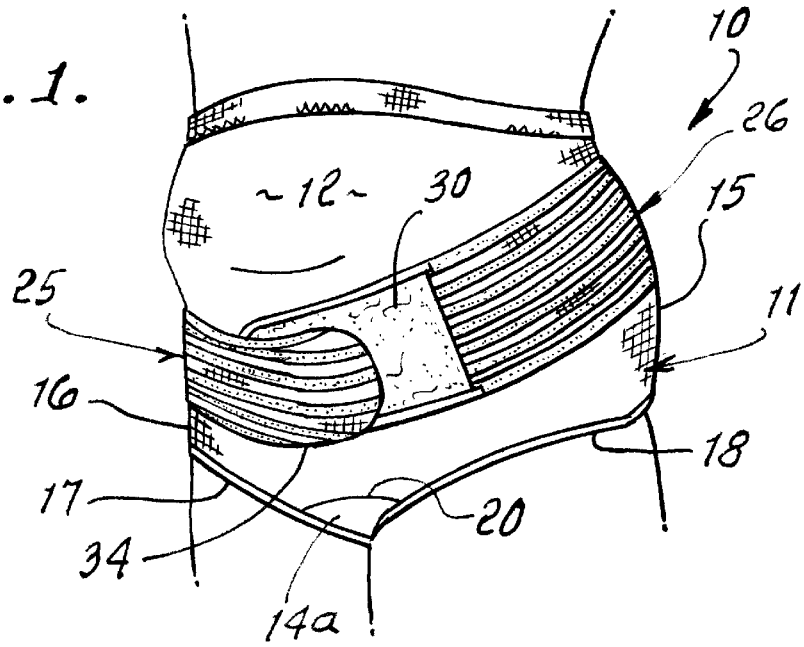
FIG. 1 is a perspective frontal view showing the preferred support garment in use.

In the drawings, the maternity support garment 10 includes a carrier configured to extend around the wearer's body, or torso, above the levels of the wearer's legs. One such carrier comprises a panty 11, having a front panel 12 to fit the abdomen, a rear panel 13, lower panel front and rear portions 14*a* and 14*b*, and panel sides 15 and 16 integral with the panels 12 and 13. Elongated seam binding loops 17 and 18 extend at the lower edges of the panels 12, 13, 15, and 16, and at the side edges of lower panel portions 14*a* and 14*b*. Stitching at 20 connects front panel 12 to lower panel portion 14*a*, and stitching at 21 connects rear panel 13 to lower panel portion 14*b*. Other carrier shapes may be used.

Figure 4:
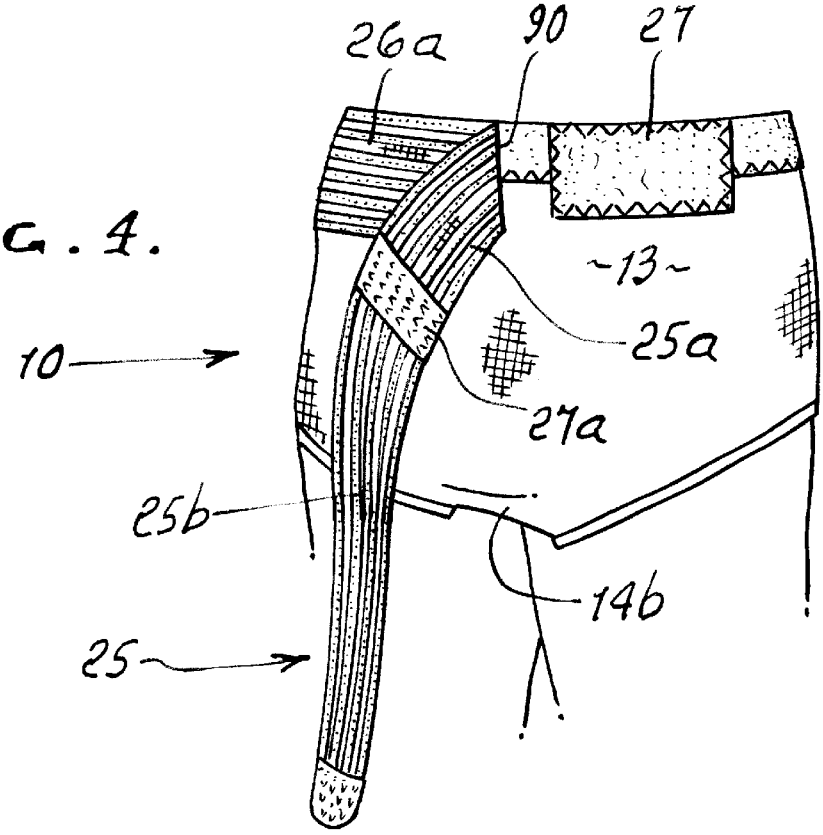
FIG. 4 is a view like FIG. 3, but showing one of the support bands in loosened condition.
Figure 5:
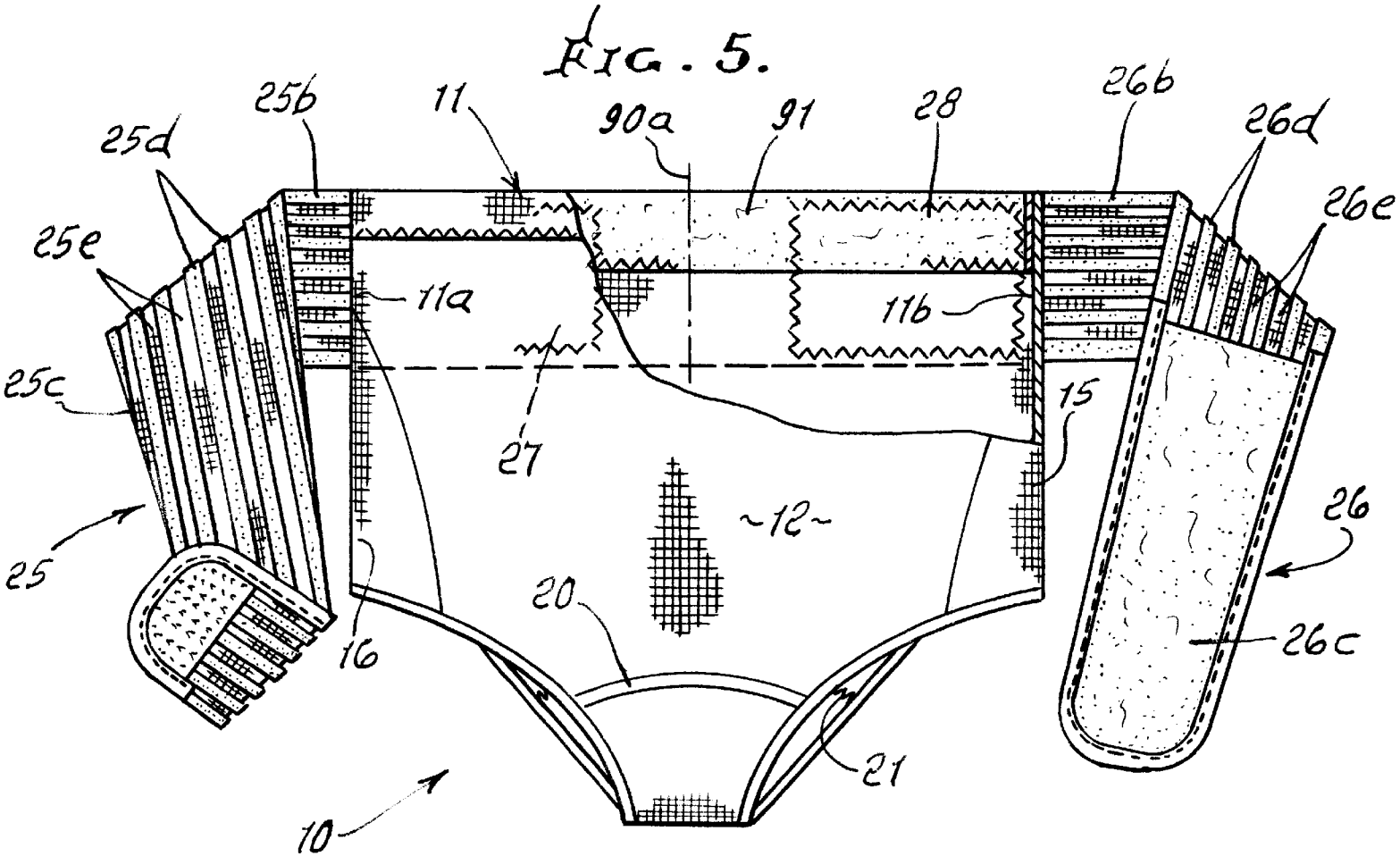
FIG. 5 is a frontal view of the support garment with each of the support bands in loosened condition.
Figure 6:
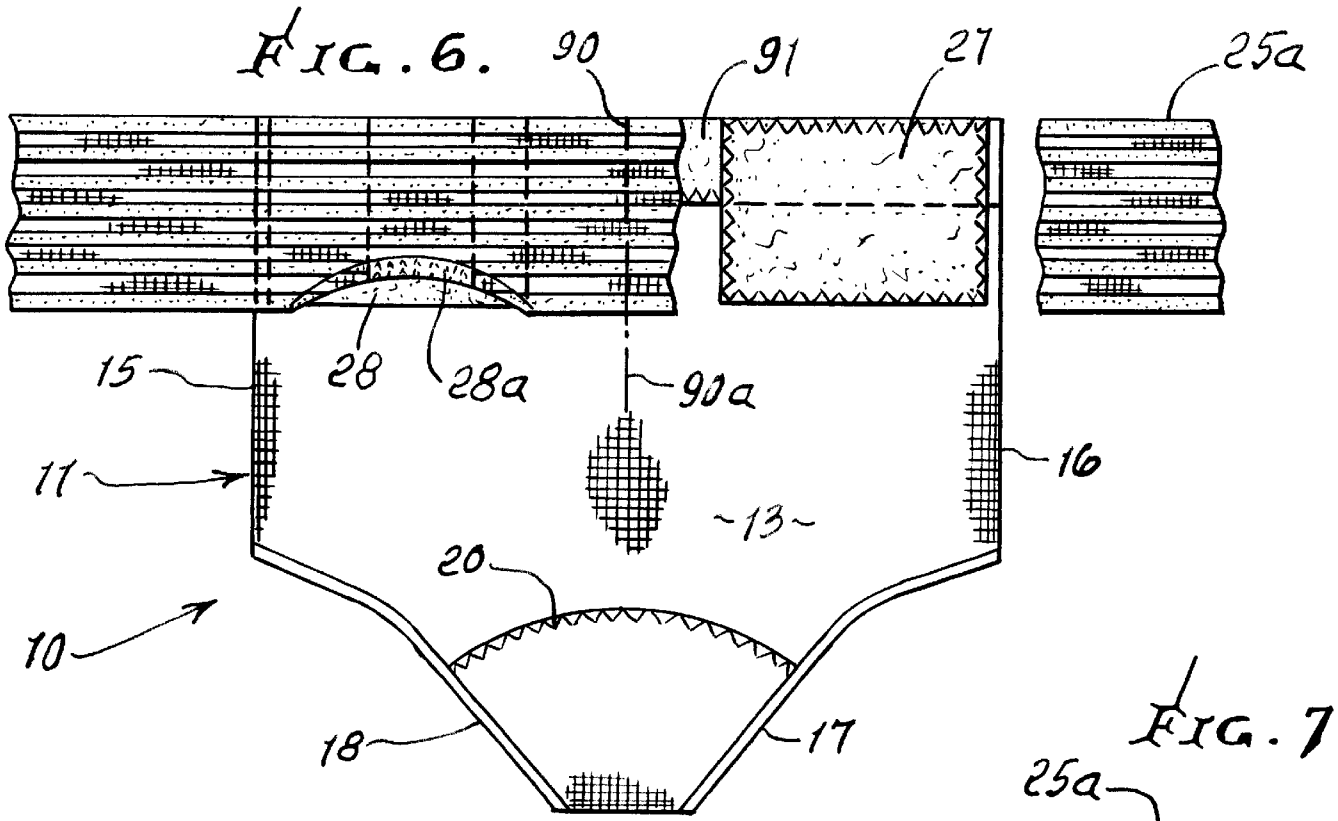
FIG. 6 is a rear view of the support garment showing an additional mode of band adjustment.

In accordance with the invention, two elongated support bands 25 and 26 are provided. They are typically elastically stretchable lengthwise. One band, as for example band 25, has a rear portion 25*a* with operative connection (see 27 and 27*a*) to the rear of the carrier as for example in the generally rectangular zone 27 which may consist of hook or pile material; a right side portion 25*b* to extend at the right side of the wearer's body and adjacent the right upper side 11*a* of the carrier or panty; and an elongated band frontal portion 25*c* freely extending (in FIG. 5) to be movable into supporting relation with the wearer's abdomen (see FIG. 1). Note in FIG. 4 the hook or pile material 27*a* on the inner side of the band rear portion 25*a* to be adjustably positioned and attached to larger area hook or pile material at 27.

The other band 26 likewise has a rear portion 26*a* with operative connection (see 26*a* and 28) to the rear of the carrier, as for example in the general rectangular area 28 (like area 27) which may consist of hook or pile material; a left side portion 26*b* to extend at the left side of the wearer's body and adjacent the left upper side 11*b* of the carrier or panty; and an elongated band frontal portion 26*c* freely extending to be movable into supporting relation with the wearer's abdomen (see FIG. 1). Bands 25 and 26 typically meet at vertical stitching 90, connecting them to the rear elasticized web 91 of the panty, at the center line 90*a*, whereby adjustments of VELCRO 27*a* on area 27, and of VELCRO 28*a* on area 28 do not affect connection 90.

Figure 2:
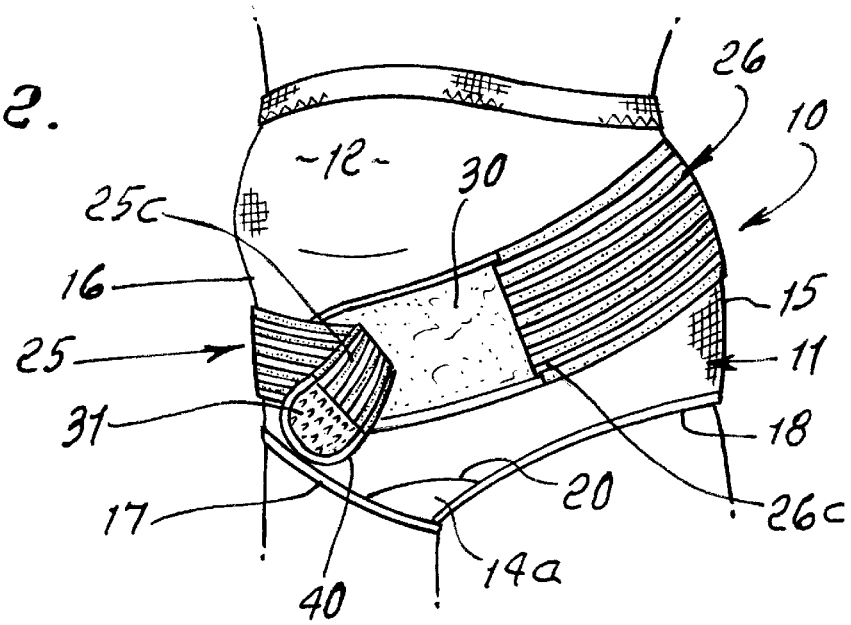
FIG. 2 is a view like FIG. 1, but showing garment adjustment.
Figure 3:
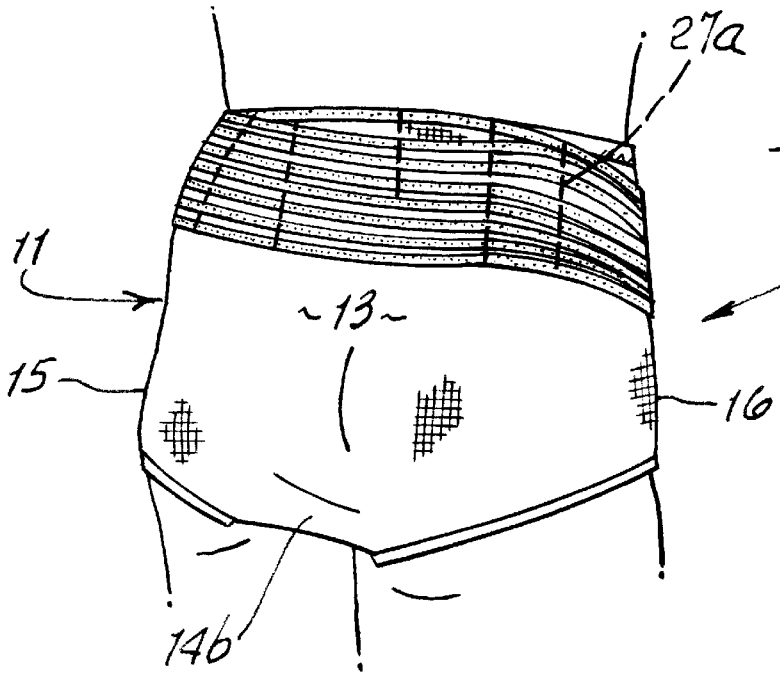
FIG. 3 is a rear view of the garment, in use.

Provision is also made for adjustable interconnection (lengthening or shortening, or relative twisting) of the two band frontal portions 25*a* and 26*a*, as for example is seen in FIG. 2. A relatively large hook or pile generally rectangular zone 30 is affixed to the outer side of band 26 frontal portion 26*c*; and a relatively smaller hook or pile zone 31 is affixed to the inner side of band 25 frontal portion 25*c*, whereby zone 31 can be adjusted lengthwise of or widthwise (up or down) of zone 30, or twisted relative to zone 30, to best suit the comfort of the wearer, at the underside 34 of the swollen abdominal zone (see FIGS. 1 and 2). This is important because the fetus position may at times shift, changing the protrusion geometry of underside 34, and the wearer is then able to quickly adjust one or more of the attachments at 30 and 31, and attachments at 27 and 27*a*, and/or at 28 and 28*a*, to restore desired comfort. Note also rounded seam binding 40 at the terminal edges of band front portion 25*c* and of hook or pile fastening zone 31, enabling easy grasping and pull-off of zone 31 from zone 30. Note also that lengthening or shortening of either of the bands 25 and 26 is also and additionally enabled as by shifting of the relative positions of the hook and pile connections of the band rear portions to the carrier or panty at the rear of the latter, as referred to above at 27 and 27*a*, and 28 and 28*a*.

A further feature is the provision of at least one of the bands to include parallel elongated relatively narrow strips of flexible material which are spaced apart widthwise of the one or both bands, and along the band lengths. See for example parallel elongated strips 25*d* spaced apart widthwise of band 25; and parallel elongated strips 26*d* spaced apart widthwise of band 26. Strips 25*d* are interconnected by lightweight fabric at parallel narrow zones 25*e*, and strips 25*d* as well as the fabric at zone 25*e* are lengthwise yieldably and resiliently stretchable, as by use of elasticized material. Likewise, parallel strips 26*d* are interconnected and thereby positioned in parallel by lightweight fabric at parallel narrow zones 26*e*, and strips 26*d* as well-as the fabric at 26*e* are lengthwise yieldably and resiliently stretchable, as by use of elasticized material. Material at 25*e* and 26*e* is perforated to enable substantial "breathing" of air and moisture through the wide bands, along their lengths. Preferably, neither of the bands 25 or 26 is widthwise resiliently stretchable. Strips 25*d* and 26*d* may consist of monofilament elastic material which is latex free, one example being LYCRA. Variable lengthwise stretching of the two relatively wide bands accommodates the bands to variably bending and twisting of the torso, as during walking or leaning, without decreasing abdomen support.

The overall band width (about 4 to 5 inches) is such as to provide optimum or near optimum lifting support to the abdomen, without adversely pressurizing the abdomen.

Figure 7:
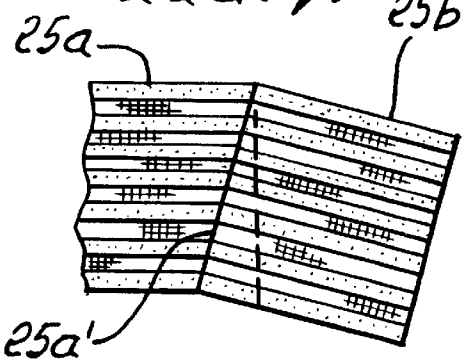
FIG. 7 is a modification showing adjustable slanting of a band.

FIG. 7 shows a modification in which a rear band as at 25*a* is adjusted as by folding at 25*a*', at an angle to re-direct band extent 25*b* at a downward and sideward slant, relative to horizontal rear band extent 25*a*. This causes band portions 25*b* and 25*c* to extend at a downward and forward slant toward the underside of the abdomen. The fold at 25*a*' may be held in position by VELCRO at overlapping locations. Band 26 may likewise incorporate provision for such folding. Bands 25 and 26 are resiliently stretchable. As used herein, LYCRA is generally synthetic material, and VELCRO is a hook and pile material.

We claim:

1. An abdominal support garment, comprising a) a carrier configured to extend around the wearer's body, above the level of the wearer's legs, b) two elongated support bands, one band having a rear portion with operative connection to the rear of said carrier, a right side portion to extend at the right side of the wearer's body; and a frontal portion to extend in supporting relation to the wearer's abdomen, and the other band having a rear portion with operative connection to the rear of said carrier, a left side portion to extend at the left side of the wearer's body, and a frontal portion to extend in supporting relation to the wearer's abdomen, c) at least one of said operative connections being adjustable to lengthen or shorten the associated bands, d) said band frontal portions being adjustably interconnected, for support of changing abdominal size, e) said band rear portions also providing optimal adjustable back support to the wearer, f) said band rear portions being both attached to the rear of the carrier between and in spaced relation to said operative interconnections.

2. The garment of claim 1 wherein the other of said operative connections is adjustable to lengthen or shorten the associated bands.

3. The garment of claim 1 wherein at least one of the bands includes parallel elongated relatively narrow strips of flexible material which are spaced apart widthwise of the one band, and along the band length.

4. The garment of claim 3 wherein the other of the bands also includes parallel elongated relatively narrow strips of flexible material which are spaced apart widthwise of said other band, and along the band length.

5. The garment of claim 4 wherein said relatively narrow strips consist essentially of monofilament elastic material, which is latex free.

6. The garment of claim 5 wherein said elastic material consists of LYCRA.

7. The garment of claim 1 wherein said band frontal portions extend in overlapping relation.

8. The garment of claim 1 wherein each of said operative interconnections includes hook and pile structure between the band rear portion and the carrier at the rear of the carrier.

9. The garment of claim 1 wherein the band rear portions are adjustably and locally anchored to the carrier, in spaced relation to said operative connection, enabling selective lengthening or shortening of the band frontal portions.

10. The garment of claim 1 wherein the carrier is a panty.

11. A maternity support garment, comprising a) a carrier configured to extend around the wearer's body, above the level of the wearer's legs, b) two elongated support bands, one band having a rear portion with operative connection to the rear of said carrier, a right side portion to extend at the right side of the wearer's body; and a frontal portion to extend in supporting relation to the wearer's abdomen, and the other band having a rear portion with operative connection to the rear of said carrier, a left side portion to extend at the left side of the wearer's body, and a frontal portion to extend in supporting relation to the wearer's abdomen, c) at least one of said operative interconnections comprising hook and pile structure between the band rear portion and the carrier at the rear of the carrier, d) said band rear portions also providing optimal adjustable back support to the wearer, e) a band rear portion being fixedly attached to the rear of the carrier, in spaced relation to at least one of said operative interconnections.

12. The garment of claim 11 wherein the other of said operative interconnections also comprises hook and pile structure between the band rear portion and the carrier, at the rear of the carrier.

13. An abdominal support garment, comprising a carrier configured to extend around the wearer's body, above the level of the wearer's legs, b) two elongated support bands, one band having a rear portion with operative connection to the rear of said carrier, a right side portion to extend at the right side of the wearer's body; and a frontal portion to extend in supporting relation to the wearer's abdomen, and the other band having a rear portion with operative connection to the rear of said carrier, a left side portion to extend at the left side of the wearers body, and a frontal portion to extend in supporting relation to the wearer's abdomen, c) at least one of said operative connections being adjustable to lengthen or shorten the associated bands, d) said band frontal portions being adjustably interconnected, for support of changing abdominal size, e) the other of said operative interconnections also comprises hook and pile structure between the band rear portion and the carrier, at the rear of the carrier, f) and wherein the band rear portions are both fixedly attached to the rear of the carrier in spaced relation to said operative interconnections.

14. The garment of claim 13 wherein the bands include parallel elongated strips of flexible material which are spaced apart widthwise of the respective bands, and which extend lengthwise of the bands, said strips being lengthwise resiliently yieldable, the number of said strips, widthwise, providing enhanced lifting support to the abdomen.

15. The garment of claim 14 wherein said strips overlap said operative connections.

16. The garment of claim 15 wherein said strips extend along said band left side portion and along said band right side portion.

17. The garment of claim 1 wherein said one band rearward portion is adjustably folded at an angle to direct said band right side portion at a downward and forward slant, generally toward the underside of the abdomen.

* * * * *